United States Patent [19]

Keddeinis et al.

[11] 4,009,748

[45] Mar. 1, 1977

[54] METHOD OF STARTING CONTINUOUS CASTING

[75] Inventors: Heinrich Keddeinis, Lintorf; Klaus Wünnenberg, Duisburg, both of Germany

[73] Assignee: Mannesmann Aktiengesellschaft, Dusseldorf, Germany

[22] Filed: Jan. 30, 1975

[21] Appl. No.: 545,416

[30] Foreign Application Priority Data

Feb. 14, 1974 Germany ..... 2407435

[52] U.S. Cl. ..... 164/73

[51] Int. Cl.[2] ..... B22D 11/08

[58] Field of Search ..... 164/73, 72, 123, 274, 164/82

[56] References Cited

UNITED STATES PATENTS

| | | | |
|---|---|---|---|
| 3,255,621 | 6/1966 | Ohsol | 164/73 UX |
| 3,318,363 | 5/1967 | Goss | 164/123 X |
| 3,509,936 | 5/1970 | Kearfott et al. | 164/72 |
| 3,726,332 | 4/1973 | Clegg | 164/274 X |
| 3,794,102 | 2/1974 | Binder | 164/73 X |

FOREIGN PATENTS OR APPLICATIONS

| | | | |
|---|---|---|---|
| 1,483,564 | 3/1969 | Germany | 164/72 |
| 1,303,358 | 9/1972 | Germany | 164/72 |
| 1,232,500 | 5/1971 | United Kingdom | 164/73 |

*Primary Examiner*—John E. Roethel
*Attorney, Agent, or Firm*—Ralf H. Siegemund

[57] ABSTRACT

The mold for continuous casting is prepared by lining the wall with glass either by pasting a glass fiber mesh thereon or by coating it with a mixture of glass powder and adhesive.

7 Claims, No Drawings

METHOD OF STARTING CONTINUOUS CASTING

BACKGROUND OF THE INVENTION

The present invention relates to a method for preparing a mold for continuous casting, prior to starting the casting process proper.

The surface level of the liquidous material e.g. steel in a mold for continuous casting is usually covered by a slag producing substance. This substance is usually applied as a powder and has a melting point below the melting point of the steel. In a refinement of this method, (U.S. Letters Patent 3,642,052) it has been proposed to use two different kinds of casting powders which differ as to melting point, and they are applied sequentially to the surface of the molten steel so that slag is produced rapidly at first followed by a slower production by the higher melting powder.

The application and utilization of powders specifically and continuous casting generally poses relatively few problems during regular operation as compared with start up. Particularly, the period from the initial filling of the mold up to the beginning of casting proper is quite difficult to control. Cracks and fissures develop in the first portion immediately adjacent to the stool, and even further up, rendering a sizeable portion of the ingot useless until in fact stabilized — stationary casting conditions have developed.

DESCRIPTION OF THE INVENTION

It is an object of the present invention to improve on the start up of continuous casting.

It is another object of the present invention to avoid the so called foot fissures or starting cracks in the ingot.

In accordance with the preferred embodiment of the invention, it is suggested to line the interior wall of a mold by means of a glass linings which is made to adhere to the wall and melts on contact with poured-in casting material under formation of slag. The glass lining may be made of glass fibers woven into the form of a flat mesh, or meshed otherwise into network, mat or the like, and that mesh is affixed to the wall mold by means of an adhesive. Alternatively, the glass is first ground into a powder which is mixed with an adhesive and the resulting paste is applied to the wall as a coating. Instead of glass, one could use a powder that is a mixture of the glass components.

The melting point of the glass mold wall lining is to be below the casting temperature of the molten steel, preferably between 900° and 1200° C.

DESCRIPTION OF THE PREFERRED EMBODIMENT

A glass that meets these conditions is comprised basically of $SiO_2$, $Al_2O_3$ and CaO. By way of example, these components may have proportions in the following ranges. $SiO_2$, 20 to 50%; CaO, 10 to 35%; and $Al_2O_3$, 0 to 20%. The following additives are preferably used. $TiO_2$, 0 to 5%; $Fe_2O_3$, 0 to 20%; MgO, 0 to 20%; $Na_2O + K_2O$, 3 to 15%; $MnO_2$, 0 to 15%; and $CaF_2$, 0 to 30%; all percentages by weight.

A glass fiber mesh constituting the preferred embodiment and best mode of practicing the invention is preferably made of glass fibers with the following composition:

| | | | | | |
|---|---|---|---|---|---|
| $SiO_2$ | - | 34% | $TiO_2$ | - | 1% |

-continued

| | | | | | |
|---|---|---|---|---|---|
| CaO | - | 32% | $Fe_2O_3$ | - | 6% |
| $Al_2O_3$ | - | 7% | MgO | - | 5% |
| $CaF_2$ | - | 10% | $Na_2O + K_2O$ | - | 5% |

The mesh is cut to the dimensions of the mold and may have a thickness of about 3mm. The thickness should actually vary in accordance with the cross-section of the casting, a range from 0.5 to 10mm is envisioned here. The mold wall will at first be coated, such as spray coated or simply by brushing on an adhesive made of organic or anorganic material such as water glass, clay, polyvinylchloride etc. Subsequently, the woven mesh is just applied to wall as a lining and pressed thereagainst to stick. The adhesive will not interfere with the slag production. Particularly when organic it will disappear as soon as casting has begun.

The glass can be used in powdery form instead, and one will mix such an adhesive with the powder to obtain a paste. That mixture is then applied to the mold wall e.g. by spraying or simply by brushing the paste onto the wall. The glass may not be a complete glass compound but the components may suffice.

In either case, coating or mesh, the mold wall will be lined with a glass cover, coating etc. As casting begins, the molten steel will not be quenched so severely becuase it is not brought into immediate contact with the cold mold wall. Moreover, the casting substance is no longer a loose powder so that the danger is avoided that powder particles enter the main stream of the molten steel and become inclusions in the interior of the ingot. Already on filling and upon beginning of withdrawal of the ingot, one needs only little thermal energy to melt the lining on the mold wall, and at least its surface will melt instantly so that right from the start a thin lubricating film is present as between steel and mold. This lubrication facilitates the shrinking of the intially quite thin skin of the casting ingot, and it can be more easily withdrawn from the mold. Once the casting process has started, one can continue in the conventional way by applying casting powder to the surface of the molten steel.

The invention is not limited to the embodiments described above but all changes and modifications thereof not constituting departures from the spirit and scope of the invention are intended to be included.

We claim:

1. Method of starting continuous casting using a mold with a wall and from which an ingot is withdrawn from the bottom as molten metal is poured into the top of the mold, comprising the steps of lining the interior wall surface of the mold with glass;

using an adhesive to hold the lining on the inner surface of the mold prior to the beginning of casting;

pouring metal into the mold for continuous casting, whereby the glass lining melts to form a lubricating flux layer;

and replenishing the flux layer by casting powder.

2. Method as in claim 1, wherein the glass is a fiber mesh applied to the wall by an adhesive as applied between the mesh and the wall.

3. Method as in claim 1, wherein the glass is a powder mixed with an adhesive to form a paste which is applied to the wall.

4. Method as in claim 1, using a glass having the following composition: $SiO_2$, 20 to 50%; CaO,10 to 35%; $Al_2O_3$, 0 to 20%; $TiO_2$, 0 to 5%; $Fe_2O_3$, 0 to 20%; MgO, 0 to 20%, $Na_2O + K_2O$, 3 to 15%; $MnO_2$, 0 to 15%; and $CaF_2$, 0 to 30%; all percentages by weight.

5. Method as in claim 1, using a glass having the following composition:

| | | | | | |
|---|---|---|---|---|---|
| $SiO_2$ | – | 34% | $TiO_2$ | – | 1% |

-continued

| | | | | | |
|---|---|---|---|---|---|
| CaO | – | 32% | $Fe_2O_3$ | – | 6% |
| $Al_2O_3$ | – | 7% | MgO | – | 5% |
| $CaF_2$ | – | 10% | $Na_2O + K_2O$ | – | 5% |

6. Method as in claim 1, for the continuous casting of steel using a glass with a melting point below the melting point of liquid steel.

7. Method as in claim 1 and using a glass having a melting point between 900° and 1200° C.

* * * * *